US005181353A

United States Patent [19]

Harrington, Jr.

[11] Patent Number: 5,181,353

[45] Date of Patent: Jan. 26, 1993

[54] FOAM SANDWICH ENCLOSURE WITH INTERLOCKING INTEGRAL FRAME

[76] Inventor: James T. Harrington, Jr., 9500 NW. 27th Ave., Miami, Fla. 33147

[21] Appl. No.: 787,529

[22] Filed: Nov. 4, 1991

[51] Int. Cl.[5] ..... E04C 2/46; E04B 1/343

[52] U.S. Cl. ..... 52/79.1; 52/309.9

[58] Field of Search ..... 52/79.1, 309.9, 265, 52/271, 281, 282, 285

[56] References Cited

U.S. PATENT DOCUMENTS

| | | | |
|---|---|---|---|
| 3,541,747 | 11/1970 | Olson et al. | 52/309.9 |
| 3,719,016 | 3/1973 | Randolph | 52/271 |
| 3,746,388 | 7/1973 | Robinson | 296/28 M |
| 3,968,989 | 7/1976 | Schippers | 296/29 |
| 4,258,519 | 3/1981 | Hugens | 52/282 |
| 4,587,783 | 5/1986 | McCoy et al. | 52/282 |
| 4,774,794 | 10/1988 | Grieb | 52/309.9 |
| 4,891,923 | 1/1990 | Evicsson et al. | 52/309.9 |
| 4,964,252 | 10/1990 | Guliker | 52/282 |

OTHER PUBLICATIONS

Inner-Seal OSB Sheathing/Louisiana Pacific/Sep. 1989, 4 sheets.

Insulspan Technical Data/Foam Products Corp. PFS Report 511 1 sheet.

R-Control Structural Building Panel 07420/FM 1990/7 Sheets.

Panel Technology Building Systems, Inc. 1989/4 Sheets.

Styrpor News (Blue 1.04) BASF Corp. Feb. 29, 1988 1 Sheet.

*Primary Examiner*—David A. Scherbel
*Assistant Examiner*—Michele A. VanPatten
*Attorney, Agent, or Firm*—Alvin S. Blum

[57] ABSTRACT

An insulated building is constructed of panels that have a rigid, closed cell foam sandwiched between, and bonded to high tensile strength outer sheets. The outer sheets extend beyond the edges of the foam to provide grooves along the edges of the panels. The panels are joined together by elongate edge connectors. Each edge connector is formed by extrusion of a high tensile strength outer layer enclosing a rigid foam core. From the central body of the edge connector, tongues extend out at fixed angles corresponding to the angle between panels. The tongues are bonded into the grooves in the panel edges. End connectors fit telescopically into the ends of adjoining edge connectors and are bonded in place to form an integrated frame interlocked with the panels.

6 Claims, 3 Drawing Sheets

FIG. 1A
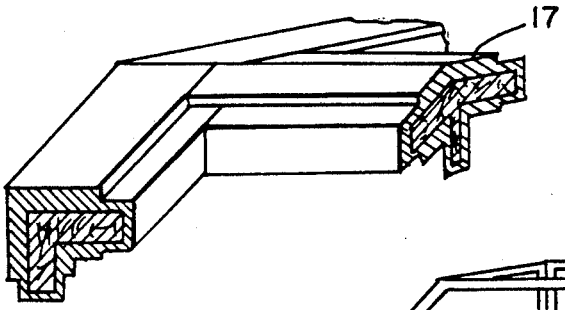
FIG. 1B
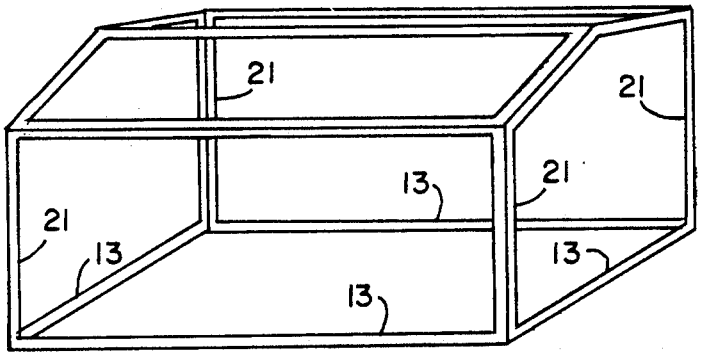
FIG. 1C
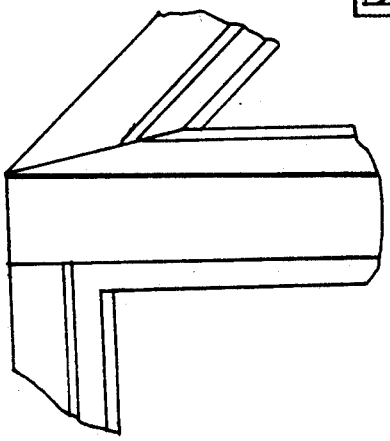
FIG. 1D
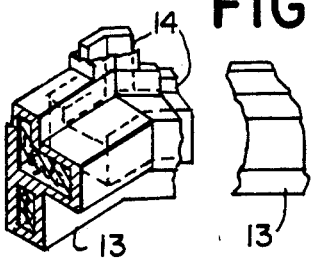
FIG. 1F
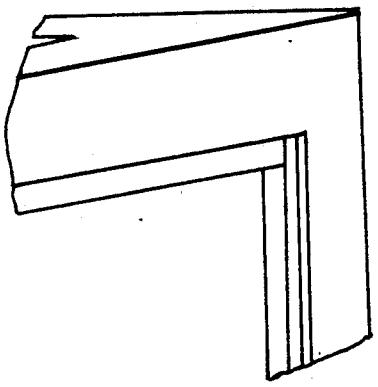
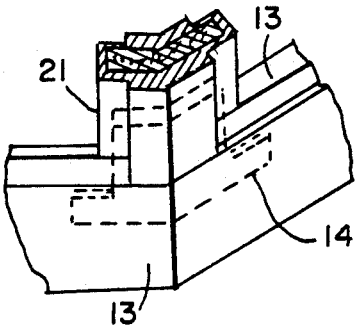
FIG. 1E FIG. 2
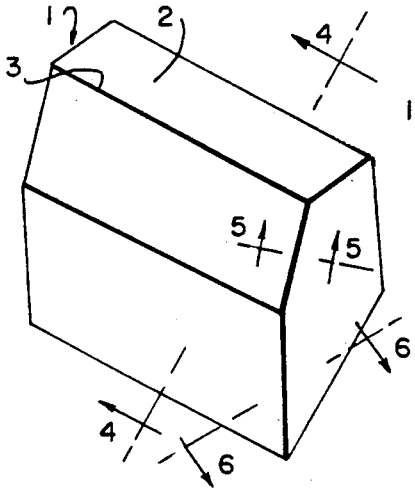
FIG. 3
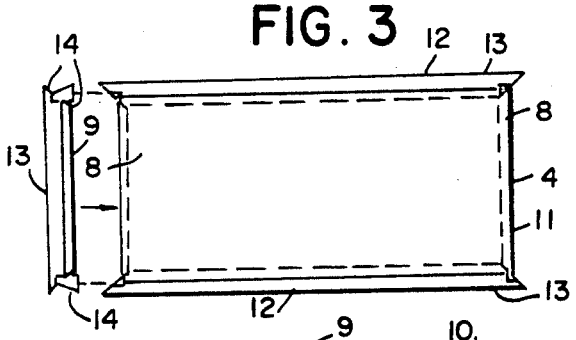
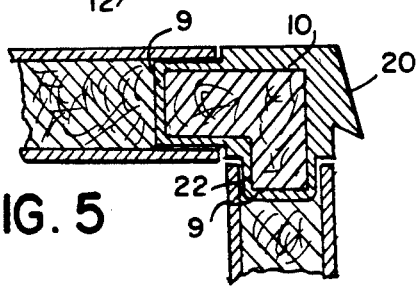
FIG. 5
FIG. 4
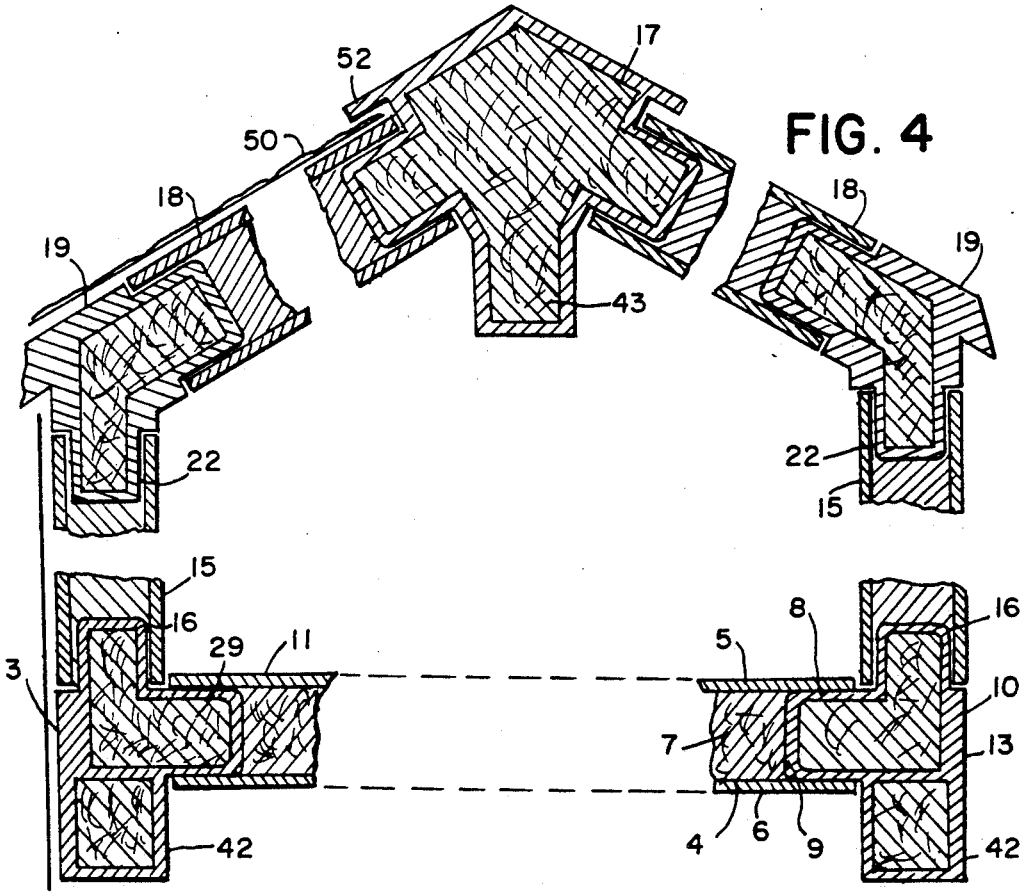

FIG. 6
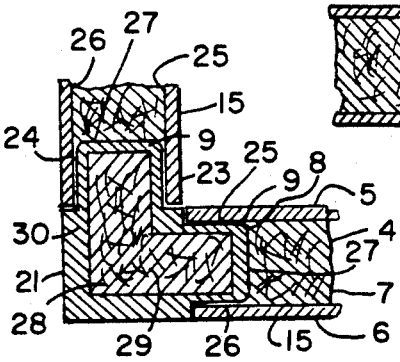
FIG. 7
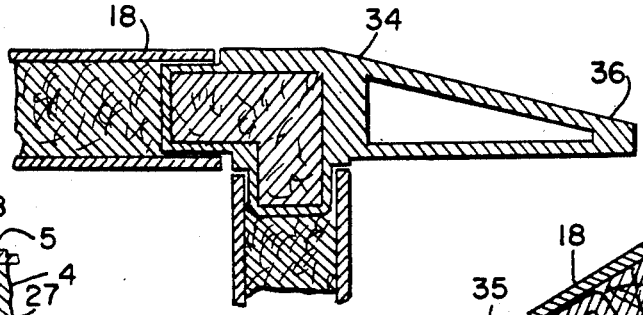
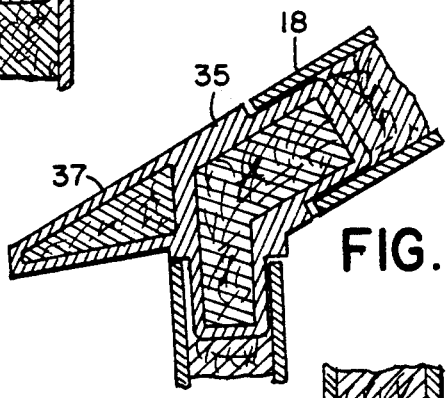
FIG. 8
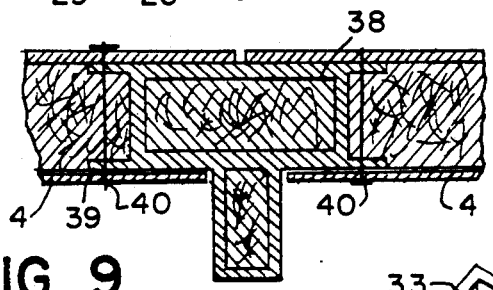
FIG. 9
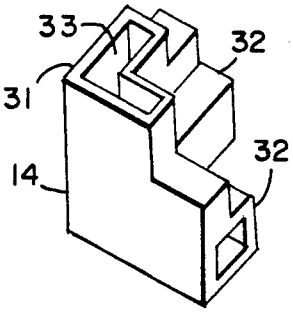
FIG. 11
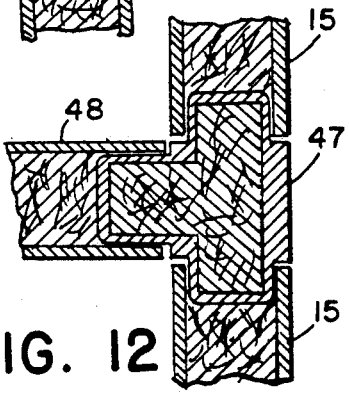
FIG. 12
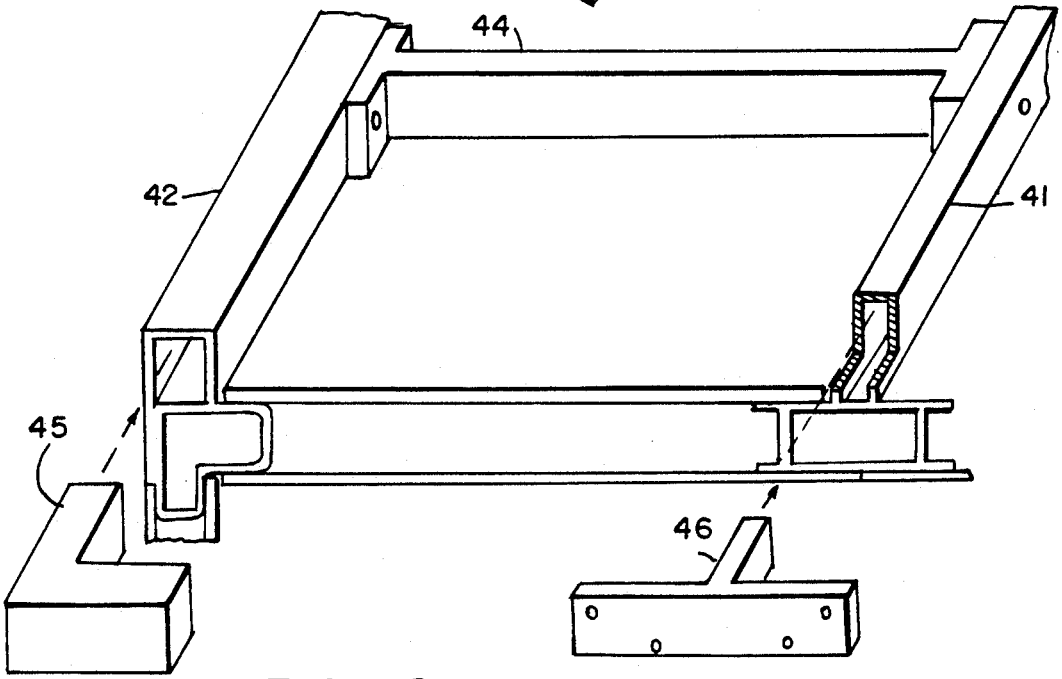
FIG. 10

FOAM SANDWICH ENCLOSURE WITH INTERLOCKING INTEGRAL FRAME

BACKGROUND OF THE INVENTION

This invention relates to enclosure structures, and more particularly to such structures suitable for fixed or mobile use that employ foam sandwich panels of the type having a rigid foam core with high tensile strength inner and outer faces for high strength, light weight and superior insulation.

Recent developments in the production of foam sandwich building panels have provided an inexpensive, strong, light-weight and insulating building panel to the construction industry. The core is generally a rigid, closed cell foam of polystyrene or polyurethane. The inner and outer skins may be plywood, oriented wood fiber board, plastic, metal and the like. The skins have high tensile strength so that, when bonded to the core, they serve as the flanges of a girder with the core serving as incompressible web. The result is a rigid broad panel that can take heavy loads without other supports. These panels have been used effectively with ordinary wood timber frames by nailing the panels to the frames.

This type of construction, using oriented fiber board (OFB) panels has become an industry standard. The panels are faced inside with gypsum board and outside with weatherproofing material. The panels permit spanning large areas without intermediate frame support. Vertical walls are generally four inches thick and horizontal, load bearing floors and roofs are generally six or eight inches thick depending on unsupported span length. The result is a well-insulated heavy building, but the costs are high because the frame involves labor and materials similar to convention construction with the foam panels exceeding the cost of conventional materials. Furthermore, the wood timber framing that joins adjacent panels has fibers that run parallel to the panel edge. Stresses transferred from the panel to the frame tend to pull the frame fibers apart, i.e. the frame joining panels has longitudinal, but not transverse strength, and it is the transverse strength that maintains the relative position of the panels.

Consequently, this type of construction has not found favor for transportable structures such as mobile homes, railroad or truck bodies or inexpensive prefabricated buildings that are subject to irregular lateral forces.

SUMMARY OF THE INVENTION

It is accordingly an object of the invention to provide a strong, light weight, rigid, inexpensive building method and structure that takes full advantage of the unique properties of foam sandwich building panels by combining them with a unique interlocking integral frame structure.

The frame structure of the invention includes elongate high-strength, rigid, tubular edge connectors that connect to the edges of adjacent foam panels to join the panel together along their entire edges with a connection that uses the same high tensile strength skin-and-foam-core structural principles as the panels. The edge connector connects with the edge of each panel by means of a tongue on the connector that fits into a groove in the edge of the panel. The groove is formed by absence of foam core at the panel edge so that the inner surfaces of the two sheets that make up the outer faces of the panel are exposed for engagement and adhesive bonding to two faces of the tonque when it is inserted into the groove. Bonding the sheets to the tongue continues the high tensile strength of each sheet onto the high tensile strength of the edge connector and the tongues of adjacent panels are joined together by high tensile strength elements of the edge connector. To impart rigidity to the edge connector to maintain the relative position of adjoining panels, the tubular edge connector is filled with a rigid foam. This holds the outer, high tensile surface layers of the connector in spaced apart relationship just as the foam core of the panel does. The elongate edge connectors thereby possess both longitudinal and transverse rigidity, making effective frame members that are rigid, insulating, and light in weight. Rigid inner joint members are provided where two or more edge connectors meet. These are arranged to fit telescopically into the foam space of the edge connectors so that when they are adhesively bonded to the edge connectors, a complete integral rigid frame for the building structure is provided, with each foam panel interlocked on all its edges with the tongues on the frame.

The face sheets of the panels and the connectors may be metal, plywood, wood fiber board, plastic, reinforced plastic and the like. The foam core may be closed cell rigid foam made from a variety of materials including polystyrene, polyurethane and the like.

BRIEF DESCRIPTION OF THE DRAWINGS

FIG. 1 is a perspective view of a frame of the invention with portions expanded for clarification of details.

FIG. 2 is a perspective view of a building structure of the invention.

FIG. 3 is a plan view of a floor of the structure with edge connectors partially installed.

FIG. 4 is a sectional view taken through line 4—4 of FIG. 2 with portions broken away.

FIG. 5 is a sectional view taken through line 5—5 of FIG. 2.

FIG. 6 is a sectional view taken through line 6—6 of FIG. 2.

FIG. 7 is a sectional view of a roof edge connector with cantilevered eave.

FIG. 8 is a sectional view of another roof edge connector with cantilevered eave.

FIG. 9 is a sectional view of a spline connector joining two panels in a common plane.

FIG. 10 is a perspective view of the underside of a floor of the invention with accessory reinforcing connectors.

FIG. 11 is a perspective view of a telescoping joint member for joining three edge connectors together.

FIG. 12 is a sectional view through an edge connector that joins a first floor vertical wall to a second floor vertical wall and a floor/ceiling panel therebetween.

These and other objects, advantages and features of the invention will become more apparent when the detailed description is read in conjunction with the drawings.

DETAILED DESCRIPTION OF PREFERRED EMBODIMENTS

Referring now first to FIG. 2, a complete building enclosure 1 of the invention is shown with a roof 2 with a ridge 3. Other shape roofs including flat roofs may be provided. Althoug FIG. 1 shows the assembled integral frame of the building, it cannot be assembled in the usual fashion with the foam panels added thereafter, due to the interlocking nature of the frame. As best seen in FIGS. 3-6, each foam sandwich panel 4 is composed of a high tensile strength inner face sheet 5 and a high tensile strength outer face sheet 6 separated by and bonded to, a rigid, closed cell foam core 7 that is much thicker than the face sheets. Any forces applied to a face sheet that would tend to bend it are converted to compression of the core and tension on the opposite face sheet. That face sheet, being highly resistant to stretching, resists the force. This construction thereby provides a very rigid, high strength structure with the economical use of thin layers of high-tensile strength materials. The light weight, inexpensive foam core not only serves as a spacer between the high-tensile strength layers, but it also provides sound and thermal insulation. The structure has many of the features of an I beam girder with the face sheets serving as the flanges and the foam as the web.

Each panel is provided with grooves 8 along each edge. The inner and outer face sheets extend beyond the foam core at each edge to form the grooves 8. Each groove is provided to receive the tongue 9 of an elongate edge connector 10. FIG. 3 shows how a bottom panel 11 is joined first along its long sides 12 to bottom edge connectors 13 by coating the tongues 9 with adhesive bonding agent and inserting them into the grooves 8 in the panel. Then an inner joining member 14 (FIG. 11) is cemented into each mitered end of a short edge connector 13. That edge connector is then cemented by its tongue 9 into the groove 8 in one of the short ends of the bottom panel. All of the edge connectors 13 are cemented to the bottom panel 11. Vertical edge connectors 21 (FIG. 6) are applied to wall panels 15, then the vertical wall panels 15 may be fitted in place over the upwardly projecting tongues 16 of the bottom edge connectors 13. The roof panels 18 are joined together at the ridge piece edge connector 17 and then the roof edge connectors 19 and 20 are joined to the perimeter of the joined roof panels. Then the roof is fitted over the wall panels 15, with the tongues 22 of the roof edge connectors being cemented into the grooves along the top of the wall panels.

Referring now to FIG. 6, the vertical edge connector (FIG. 11) 21 that joins together two vertical wall panels 15 at a corner is exemplary of the edge connector structure that will now be described in detail. A plurality of tongues 9 extend out from a central body 30 at fixed angles corresponding to the desired angle between adjoining panels. Each tongue 9 has a first broad surface 23 for bonding to the inner surface 25 of the inner sheet 5 of the panel in the groove 8 and a second broad surface 24 for bonding to the inner surface 26 of the outer sheet 6 in the groove. Each bonding surface is approximately two inches wide by the length of the edge. With modern adhesives, this overlapping joint with a snug fit of tongue in groove can be provided with as much strength as the face sheet. The edge connector is formed of a high tensile strength material. Having a uniform cross section it can be economically produced by extrusion in aluminum, plastic, reinforced plastic and the like. The first and second tongue bonding surfaces are spaced apart by a distance substantially equal to the thickness of the foam core for a snug fit in the groove. The spacing is maintained by the web 27 and the rigid foam core 28 filling the inner space 29. The bonding surfaces on the tongues 9 are connected together by the high tensile strength perimetral layer of the connector while they are maintained spaced apart by the foam 28. This structure is analogous to the foam sandwich structure of the panels, thereby providing an integral foam sandwich construction at the edges of adjoining panels as well as within the panels.

Referring now to FIGS. 1 and 11, the inner joining member means for joining together the ends of adjacent edge connectors are exemplified by the inner joining member 14 for joining together the ends of two bottom edge connectors 13 to the lower end of a vertical connector 21. The joining member 14 is provided with a plurality of projections, each arranged to be telescopically fitted within, and bonded to, the inner space 29 of an edge connector that is devoid of foam. This may be managed by routing out the foam from the edge connector at that point. Projection 31 fits into the space 29 of a vertical edge connector (FIG. 6). Projections 32 fit into the spaces 29 of two bottom edge connectors 13 (FIG. 4).

The inner joining member may be provided with a through hole 33. The inner spaces of all the edge connectors may be provided free of foam and the foam applied to all those inner spaces after they are connected together by these inner joining members using foam in place technology. This provides an integral frame in which all of the frame members are not only bonded together with adhesive, but also have an integral foam frame. Certain high density foams have considerable structural strength such as those used in place of wood frames in furniture.

FIGS. 7 and 8 illustrate roof edge connectors 34, 35 that provide cantilevered eaves 36, 37.

FIG. 9 illustrates an edge connector 38 for splicing together two foam panels 4 that are in the same plane. Also illustrated are tongues 9 provided with thin nail flanges 39 for nails 40 that may be used separately or in conjunction with adhesive bonding on any tongues.

Edge connectors may be provided with accessory girder elements for extra strength such as shown as 41 in FIG. 9 and 42 for floor edge connectors and 43 for ridge piece connector. FIG. 10 illustrates how a strut 44 may be bolted between girder elements 42, 41 for additional strength. A corner connector 45 telescopically joins the ends of two girders together. A T connector 46 telescopically bonds to a first girder 41 and bolts to a second, transverse girder (not shown). These arrangements may be suitable for heavy loads.

FIG. 12 shows an edge connector 47 that joins the vertical wall panel 15 of a first story to a wall panel 15 of a second story with a floor/ceiling panel 48 of a two story structure. Total panel thicknesses for vertical walls of four inches and horizontal panels having total thicknesses of six and eight inches are suitable for these purposes, with ½ inch thick plywood or wood fiber face sheets.

Incorporated herein by reference is literature describing foam sandwich panels with oriented strand board face sheets suitable for this invention along with specifications for strength of the face sheets exemplary of the high tensile strength materials described.

The exterior of the building may require the application of waterproof membranes to the foam panel structure. The edge connectors may be arranged to provide a flush fit with the outer surface of the panel so that a membrane will securely cover the joint. This is best seen in FIG. 4 where the waterproof membrane or siding 49 fits smoothly over the wall panel joints with the edge connectors and built in drip strips 51 on roof edge connector carries water away from the upper edge of the membrane. Roof membrane 50 fits smoothly over the joint at the roof edge and drip strip 52 on edge connector 17 protects the upper edge of the roof membrane.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An insulated building structure comprising:

A) at least one bottom horizontal foam sandwich panel;

B) at least one top horizontal foam sandwich panel;

C) a plurality of vertical wall foam sandwich panels joining together said top and bottom foam sandwich panels and joined to one another to form an enclosure within said panels;

D) each of said foam sandwich panels having a rigid closed-cell foam core with two broad, flat faces, said core sandwiched between, and bonded to, a first broad flat outer face sheet on a first face and a second broad flat inner face sheet on a second face, each said face sheet having a high tensile strength much greater than that of said core, having a thickness less than half that of said core, and extending beyond the edges of said core to define grooves along each edge of said panel;

E) integral, interlocking frame means rigidly joining together said panels along said edges, said frame means including:

a) a plurality of elongate, foam-core edge connectors, each edge connector comprising: an inner space filled with a rigid foam center enclosed by a tubular, high tensile strength outer layer having a thickness less than that of said inner space, said edge connector having a uniform cross sectional profile for manufacture by extrusion; said outer layer defining a central body portion and a plurality of tongues extending from said central body at fixed angles to one another to correspond to the angle between adjoining panels; each said tongue arranged to fit snugly within the groove at the edge of a panel, and having a flat first bonding surface bonded to the inner surface of the first face sheet of said panel and a flat second bonding surface bonded to the inner surface of the second face sheet of said panel within said groove and a third bonding surface connecting said first and second bonding surfaces bonded to said foam core within said groove, said first and second bonding surfaces being substantially parallel to one another and perpendicular to said third bonding surface, said first and second bonding surfaces being spaced apart by said inner space a distance substantially equal to the thickness of said core of said panel said connectors having a cross section with a foam inner space completely encircled by said high tensile strength outer layer;

b) a plurality of end joining means rigidly connecting together the ends of adjacent edge connectors, each said joining means including a main body; a plurality of inner members projecting outwardly from said main body at angles to one another corresponding to the angles between adjacent edge connectors, each inner member fitting snugly within the inner space at the end of said edge connector, said inner space being devoid of foam to receive said inner member telescopically therein with bonding means fixedly bonding said inner member to the inner wall of said outer layer of said edge connector to thereby form an integral bonded frame interlocked and bonded to said panels with high tensile layers spaced apart by rigid foam.

2. The building structure according to claim 1, in which certain of said edge connectors are provided with girder means projecting outwardly from said central body for providing extra rigidity to said frame, said girder means having elongate, high tensile strength sides joined together by a high tensile strength end portion, said sides and end portions enclosing a rigid, closed cell foam.

3. The building structure according to claim 1, in which said edge connectors join said panels to present a flush surface at certain joints therebetween for enhanced application of covering materials thereto.

4. The building structure according to claim 3, in which certain edge connectors are provided with projections which extend beyond the exterior face of said panel.

5. The building structure according to claim 1, in which at least some of said tongues are provided with accessory flanges extending from said first and second bonding surfaces beyond said third bonding surface.

6. The building structure according to claim 1, in which a foam core within the edge connector and within the end joining means is foamed in place after the structure is assembled for enhanced integration of said structure.

* * * * *